US010975533B2

(12) United States Patent
Sternberg et al.

(10) Patent No.: US 10,975,533 B2
(45) Date of Patent: Apr. 13, 2021

(54) MODULAR TURF SYSTEM AND METHOD OF TURF INSTALLATION

(71) Applicant: Perfect Turf LLC, Schaumburg, IL (US)

(72) Inventors: David J. Sternberg, Schaumburg, IL (US); Matthew V. Scavo, North Barrington, IL (US)

(73) Assignee: Perfet Turf LLC, Schaumburg, IL (US)

( * ) Notice: Subject to any disclaimer, the term of this patent is extended or adjusted under 35 U.S.C. 154(b) by 261 days.

(21) Appl. No.: 15/289,930

(22) Filed: Oct. 10, 2016

(65) Prior Publication Data

US 2017/0101743 A1 Apr. 13, 2017

Related U.S. Application Data

(63) Continuation-in-part of application No. 13/419,310, filed on Mar. 13, 2012, now Pat. No. 9,464,388.

(51) Int. Cl.

| | |
|---|---|
| ***E01C 13/08*** | (2006.01) |
| ***A63C 19/04*** | (2006.01) |
| ***E01C 13/04*** | (2006.01) |
| ***E01C 13/02*** | (2006.01) |
| *E01C 11/22* | (2006.01) |

(52) U.S. Cl.

CPC ..... *E01C 13/08* (2013.01); *A63C 19/04* (2013.01); *E01C 13/02* (2013.01); *E01C 13/045* (2013.01); *E01C 13/083* (2013.01); *E01C 11/225* (2013.01)

(58) Field of Classification Search

CPC ..... E01C 13/08; E01C 13/04; E01C 13/045; E01C 13/02; E01C 19/52; E01C 11/225; E01C 2201/12; E01C 2201/14; E01C 2201/16; E01C 13/083; A63C 19/04

See application file for complete search history.

(56) References Cited

U.S. PATENT DOCUMENTS 4,913,596 A * 4/1990 Lambert, III ..... E01C 13/083 405/36
7,273,642 B2 * 9/2007 Prevost ..... A63C 19/04 428/17

(Continued)

FOREIGN PATENT DOCUMENTS

CN 206245183 U * 6/2017

OTHER PUBLICATIONS

CN 206245183 U, Google translation, 2017.*

*Primary Examiner* — Cheryl Juska
(74) *Attorney, Agent, or Firm* — Charles T. Riggs, Jr.

(57) ABSTRACT

The present subject matter relates to a method and system for synthetic turf and the installation thereof. Modular turf sections are formed by attaching a turf section to a corresponding base structure of any desired size and shape. The base structure has a smooth top surface and smooth edges, and can be cut to any desired shape, angle or cutout. The base structure may include a PVC flushing system. The modular turf sections are laid side by side to cover a surface having any size and shape. The modular turf sections are portable and can be individually lifted after having been installed, thereby allowing for cleaning, repair and/or access under one or more selected modular turf sections, or for the replacement of selected modular turf sections which become worn or damaged.

19 Claims, 6 Drawing Sheets

(56) References Cited

U.S. PATENT DOCUMENTS

| | | | | |
|---|---|---|---|---|
| 7,722,288 | B2 * | 5/2010 | Prevost | E01C 13/02 405/38 |
| 9,567,714 | B2 * | 2/2017 | Sawyer | E01C 3/006 |
| 9,670,626 | B2 * | 6/2017 | Karmie | B08B 3/04 |
| 2008/0219770 | A1 * | 9/2008 | Prevost | E01C 13/08 405/50 |
| 2009/0305798 | A1 * | 12/2009 | Harris | E01C 9/004 472/92 |
| 2015/0247293 | A1 * | 9/2015 | Allingham | B32B 5/028 472/92 |
| 2015/0267357 | A1 * | 9/2015 | Sawyer | E01C 3/006 404/2 |
| 2015/0299964 | A1 * | 10/2015 | Karmie | B08B 3/04 52/302.3 |

* cited by examiner

Figure 1
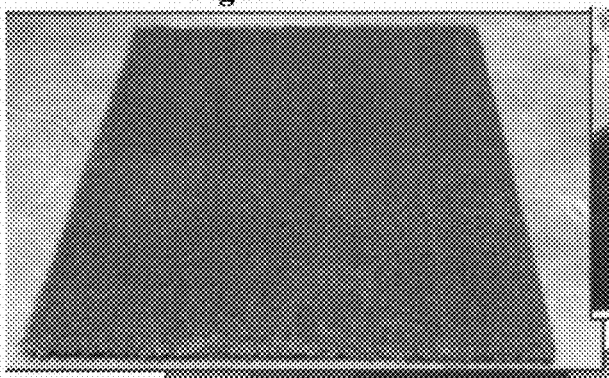
Figure 3
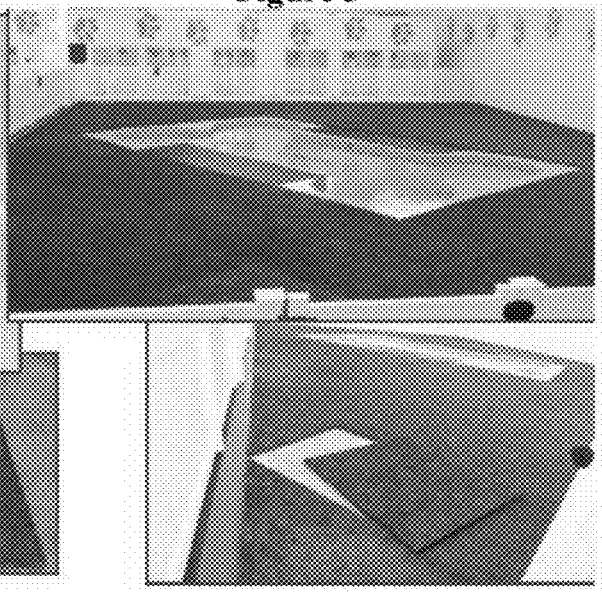
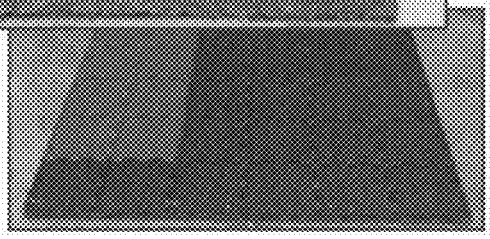
Figure 2
Figure 4
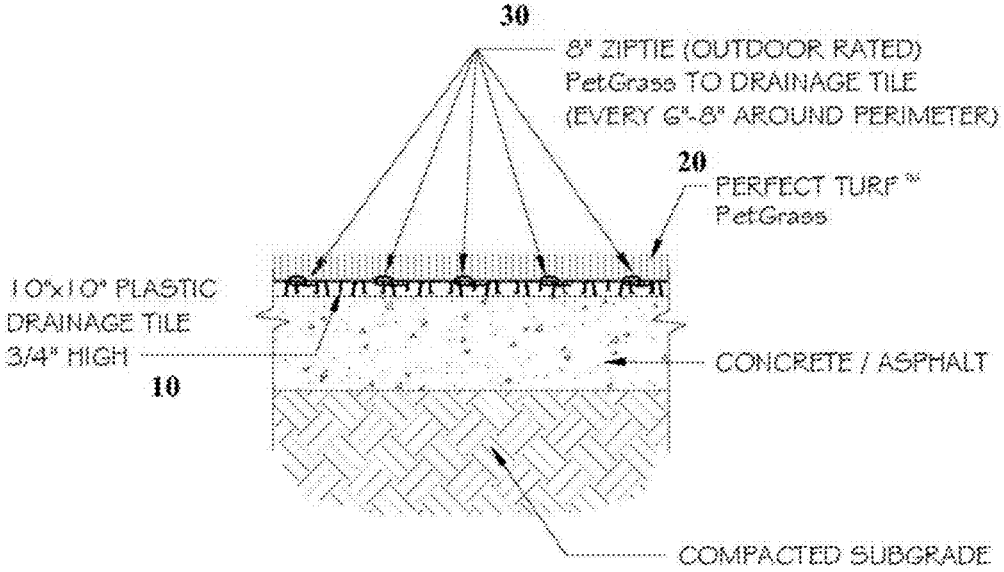
DETAIL - SYNTHETIC TURF
OVER CONCRETE / ASPHALT BASE
Figure 5

MODULAR TURF SYSTEM AND METHOD OF TURF INSTALLATION

RELATED APPLICATIONS

This application relates to U.S. patent application Ser. No. 13/419,310 filed Mar. 13, 2012, now U.S. Pat. No. 9,464,388 issue on Oct. 11, 2016.

TECHNICAL FIELD

The exemplary teachings herein pertain to methods and systems relating to synthetic turf and the installation thereof. The present disclosure relates generally to a modular turf system, and method of constructing and installing the modular turf system. In particular, the present disclosure relates to modular, self-contained sections of turf customizable to any size and shape, which provides flexibility and adjustability in both installation and maintenance. Specifically, the present disclosure relates to modular turf sections comprised of synthetic turf secured to a base structure, and installed side by side on any type of surface defining any area of any size and/or shape.

BACKGROUND

In a traditional synthetic turf installation, a base of stone, concrete or other material is laid over the area on which the turf is being installed. Rolls of synthetic turf are then spread out over the base layer, seamed together, and suitably anchored along the perimeter of the installation area. This results in one continuous, carpet-like layer of turf covering the entire area. However, such a turf installation can be time consuming and labor intensive, and difficult to seam, anchor or otherwise install within the parameters of a specified location. Further, the uniform rolls of turf can be inflexible in design or impractical for a particular use in a particular location, and must usually be professionally installed.

In the case of an indoor installation, for example, a base is typically constructed using plastic drainage tiles, similar to a landscape drainage tile having a plurality of triangular or other shaped openings, arranged to cover the entire area of installation. Once this base is constructed, installation of the turf proceeds as described above, with rolls of turf spread out over the base layer, seamed together, and suitably anchored along the perimeter of the installation area. This again results in one continuous, carpet-like layer of turf covering the entire area. Again, such a turf installation can be time consuming and labor intensive, and difficult to seam, anchor or otherwise install within the parameters of a specified location.

Once installed, the turf may be cleaned to a certain extent by rinsing with water from a hose, or lightly scrubbing with a brush and cleaning solution. However, it is not possible with such installations to clean under the carpet of synthetic turf or under the tile base, or to make repairs to or access the surface below the turf or tile base. Further, should certain areas of the carpet of turf become worn, faded, torn or otherwise damaged, the entire carpet of turf, or large sections thereof, would typically have to be replaced.

Accordingly, there is a need in the synthetic turf industry for a turf system and method of installation which is flexible in design for any location having any sized or shaped area, which is quick and easy to install in any desired configuration, and which allows for cleaning, repairs or access under the surface of the turf or turf base. The exemplary teachings herein fulfill such needs, and provide numerous other benefits and advantages in the industry. It is desired that the methods and systems for providing the above benefits be applicable to any instances or applications wherein synthetic turf or other types of porous floor coverings such as indoor/outdoor carpeting are to be installed over a suffice area of any shape or size.

SUMMARY

The exemplary technique(s), system(s) and method(s) presented herein relate to a modular turf system and method of turf installation, and in particular for the customizable installation of modular turf sections which can be selectively removed and/or replaced in a modular fashion. The exemplary method and system include utilizing a base structure of a desired size and shape, having a corresponding turf section suitably attached atop the base structure to form the modular turf section. The edges of the base structure are preferably smooth, allowing adjacent modular sections to abut up against and lie evenly next to each other, resulting in a uniform or continuous appearance.

In use, the modular turf sections are simply laid side by side in a continuous fashion until the entire surface of the desired area is covered. The modular turf sections can easily be trimmed or cut to any desired size or shape, to accommodate for different sized or shaped areas, or to install around obstacles on or in the surface of the area being covered. In this manner, installation is quick and easy and can be accomplished by non-professionals. Further, the modular system and installation allows any single modular turf section to be replaced if damaged, or removed and cleaned under and placed back into its original position.

Additional objects, advantages and novel features will be set forth in part in the description which follows, and in part will become apparent to those skilled in the art upon examination of the following and the accompanying drawings or may be learned by production or operation of the examples or teachings herein.

BRIEF DESCRIPTION OF THE DRAWINGS

The drawing figures depict one or more implementations in accord with the present teachings, by way of example only, not by way of limitation. In the drawing figures, like reference numerals refer to the same or similar elements.

FIG. 1 illustrates a perspective view of a single modular turf section.

FIG. 2 is a perspective view of the base structure of the modular turf section of FIG. 1.

FIG. 3 is a perspective view of a plurality of modular turf sections having been installed in a defined area.

FIG. 4 is a perspective view of the installed modular turf sections of FIG. 3, with one of the modular turf sections having been removed or displaced.

FIG. 5 is a schematic cross-section view of a modular turf section placed on a surface.

DETAILED DESCRIPTION

Figure 6:
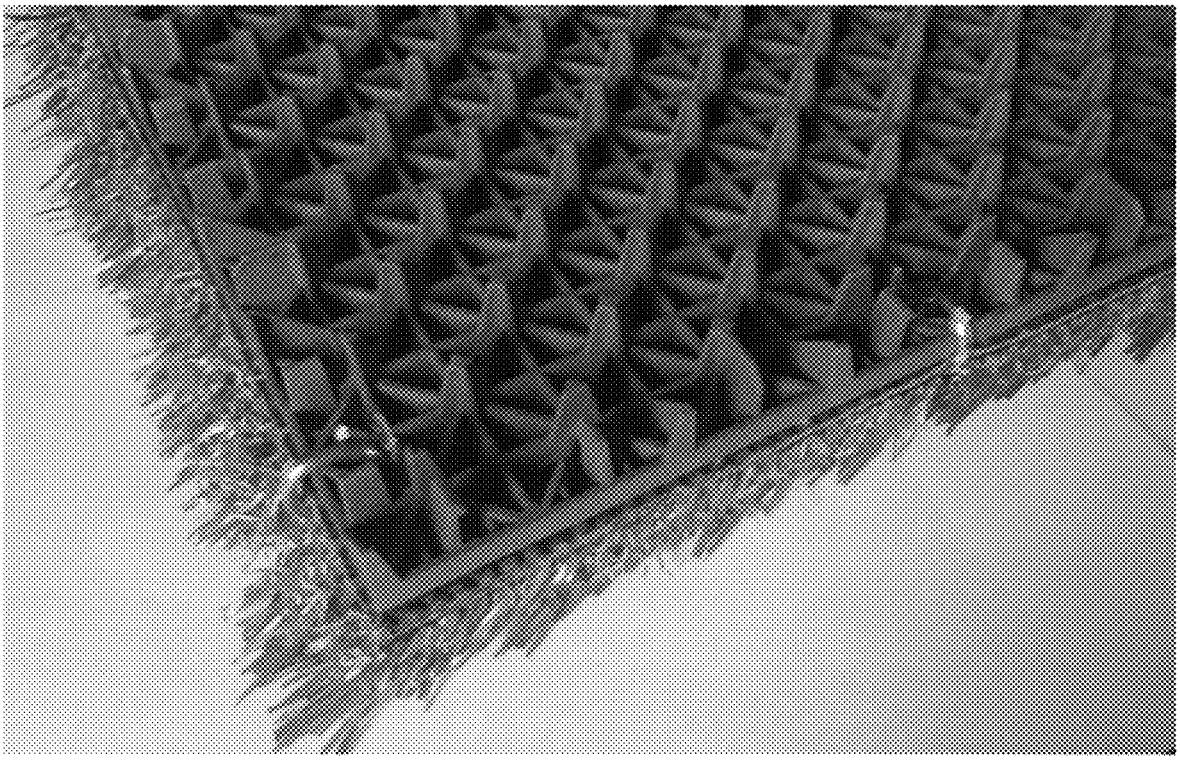
FIG. 6 is an enlarged bottom perspective view of a corner of a modular turf section.

The following description refers to numerous specific details which are set forth by way of examples to provide a thorough understanding of the relevant teachings. It should be apparent to those skilled in the art that the present teachings may be practiced without such details. In other instances, well known methods, procedures, and components have been described at a relatively high-level, without detail, in order to avoid unnecessarily obscuring aspects of the present teachings. While the description refers by way of example to synthetic turf is should be understood that the method(s) and system(s) described herein may be used for any similar type of surface coverings, and for application in any location having any size and shape.

FIG. 1 is perspective view illustrating a single modular turf section. The modular turf section comprises a base structure of a predetermined she and shape, and a corresponding turf section having the same or substantially similar size and shape as the base structure. The turf section is secured to the base section in any suitable manner, such as by hog rings or plastic zip ties, as described in more detail below.

FIG. 2 is a perspective view illustrating the base structure of the modular turf section of FIG. 1. The base structure can take any desired size and shape. The base structure can also be made from any suitable material, preferably from a rigid or semi-rigid plastic material. Other suitable material such as a metal or treated wood or composite laminate is contemplated. Further, the base structure can be a single, continuous piece, or it can be assembled from a plurality of interlocking tiles. For example, the base structure can be made from commercially available VersaCourt™ tiles from VersaCourt International, Inc. of Lamar, Mo.

FIG. 3 is a perspective view illustrating a plurality of modular turf sections having been installed, in a defined area, for example an indoor doe, care facility. The modular turf sections are laid side by side, adjacent to and abutting each other. As such, the turf appears carpet-like, as if it where one continuous, uniform piece of turf.

FIG. 4 is a perspective view illustrating the installed modular turf sections of FIG. 3, with one of the modular turf sections having been removed or displaced. As can be seen, the turf sections can simply be lifted out of place individually, and can simply be put back in place or replaced with a new modular turf section of the same size and shape. This allows any or all of the modular turf sections to be cleaned under. This also allows any or all of the modular turf sections to be selectively replaced individually if worn or damaged. This can result in significant cost savings, as well as time and labor.

As can be seen in FIG. 4, the modular turf section located above the displaced section has been cut on a diagonal, thereby allowing the modular turf system to conform to the shape of the perimeter of the area being covered by the turf. It should thus be understood that the modular turf sections can be cut to any desired size or shape, using a circular saw, a jig saw or any other suitable cutting tool. Circular, semi-circular, slotted or other shaped cutouts can also be made so that the modular turf sections can be installed around existing obstacles on or in the surface being covered with turf, such as for example a flap pole.

FIG. 5 illustrates a schematic cross-section view of a modular turf section placed on a surface. As can be seen, the modular turf section comprises a modular base structure 10, to which a corresponding sized and shaped section of synthetic turf 20 is secured along the edges thereof via suitable fasteners 30. As illustrated, the fasteners are outdoor rated zip ties. However, it should be understood that any suitable fasteners may be used, for example, staples, clips, clamps, wires or the like. In a preferred embodiment, metal hog rings are formed around the edges of the turf and the base structure using a commercially available hog ring tool. Preferably, the fasteners are located approximately every six to eight inches around the perimeter of the modular turf section, however, this distance can vary depending on preference and the amount and nature of use or traffic on the turf.

FIG. 6 illustrates an enlarged bottom perspective view of a corner of a modular turf section. In this figure, the modular turf section is shown upside down, revealing the bottom of the base structure, and the bottom of the synthetic turf attached thereto via the hog rings (two shown). As can be seen, the edges of the base structure are smooth, allowing adjacent base structures to lie flat up against the edges without any gap being formed. The base structure is formed with a plurality of openings thereby allowing liquids and small particles to pass through to the surface below. The backing of the synthetic turf also has a plurality of opening or small holes for allowing liquid and small particles to pass through to the base structure and then continuing to the surface below. This combination allows for excellent drainage and an aeration layer allowing the turf and the floor surface to dry. Alternatively, the turf can have a permeable or flow-through backing without holes, allowing liquid to pass through unobstructed.

In one embodiment, such as use in an indoor dog care facility, the synthetic turf preferably comprises commercially available PetGrass® synthetic turf from Perfect Turf LLE of Schaumburg, Ill. This turf comprises antimicrobial agents built into the yarn and backing of the turf to help eliminate odors and keep it sanitary. Accordingly, the modular turf sections can be easily rinsed, or scrubbed, and then allowed to dry, and can be lifted individually to scrub or clean the surface below the modular turf sections. Other types of synthetic turf can be used in other applications such as outdoor turf for covering old or damaged surfaces such as patios or decks.

FIGS. 7A-7I illustrate the method of making a modular turf section. The modular turf sections can be made in any size. For example, a standard size modular turf section could measure thirty-six inches by forty-eight inches, forty inches by fifty inches, etc. The base structure for such a standard sized modular turf section could be one single, continuous piece. Alternatively, the modular base structure can be constructed from a plurality of smaller snap-together tiles, such as square tiles measuring ten inches by then inches or twelve inches by twelve inches. In this manner, the modular turf sections can be customized to any size. For example, a forty inch by sixty inch modular turf section could be made from twenty-four such square tiles arranged in a four tile by six tile rectangle. A thirty-six inch by forty-eight inch modular turf section could be made from twelve square tiles of 12" by 12" arranged in a three tile by four tile rectangle.

Figure 7A:
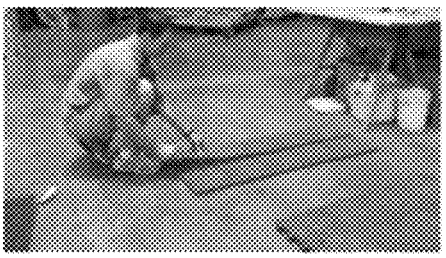
FIGS. 7A-7I illustrate the method of making a modular turf section.
Figure 7B:
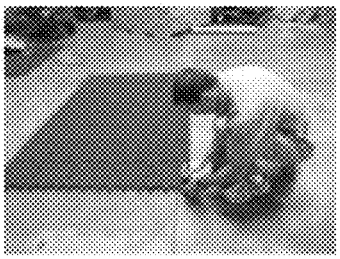
Figure 7C:
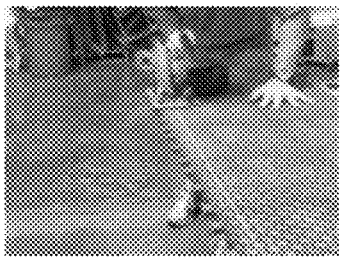

Accordingly, to make a custom sized modular turf section, the desired number of tiles are arranged in the desired shape and snapped together by their complementary connectors formed along the edge thereof, as illustrated in FIGS. 7A and 7B. If necessary, the assembled base structure is then cut to a desired size using a power saw as illustrated in FIG. 7C.

Any suitable angles, slots or holes may also be cut at this time. Also, any connectors extending from the outer edge of an assembled base structure would be cut off as well.

Figure 7D:
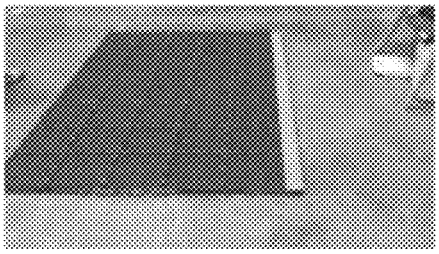
Figure 7E:
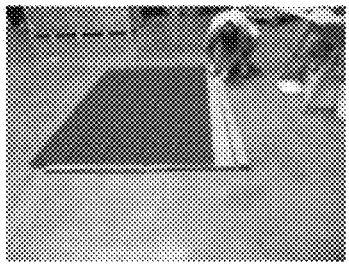
Figure 7F:
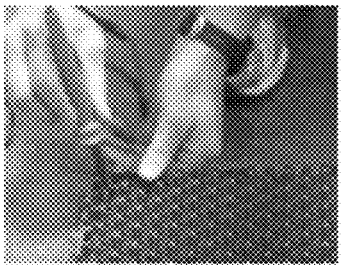

Once the base structure is formed to the desired size, the corresponding turf section is then cut, if necessary, to the same size as the base structure. This can be done by laying the upside down base structure on top of the upside down turf section, and then running, a cutting tool along the edges of the base structure, as illustrated in FIGS. 7D and 7E. Thereafter, if existing holes in the backing of the turf are not aligned closely with the edges of the base structure, new holes can be created for receiving plastic zip ties fastened manually. As shown in FIG. 7F, new holes can be formed in the turf using any suitable tool such as a soldering iron, drill, Dremel tool, awl, nail, or any hole forming implement. However, it is not necessary to form new holes when a pneumatic hog ring tool is used to fasten hogs rings thereto.

Figure 7G:
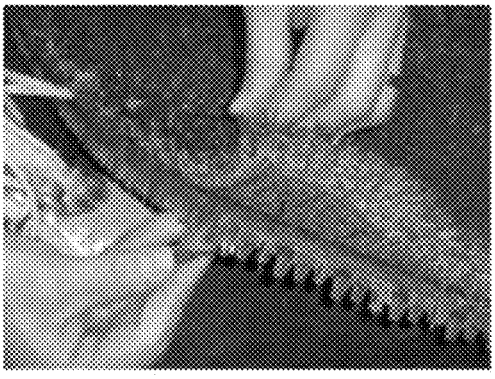
Figure 7H:
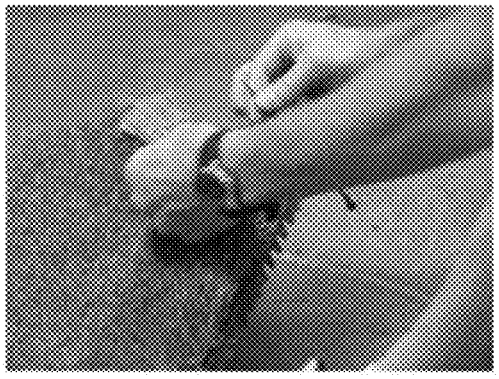
Figure 7I:
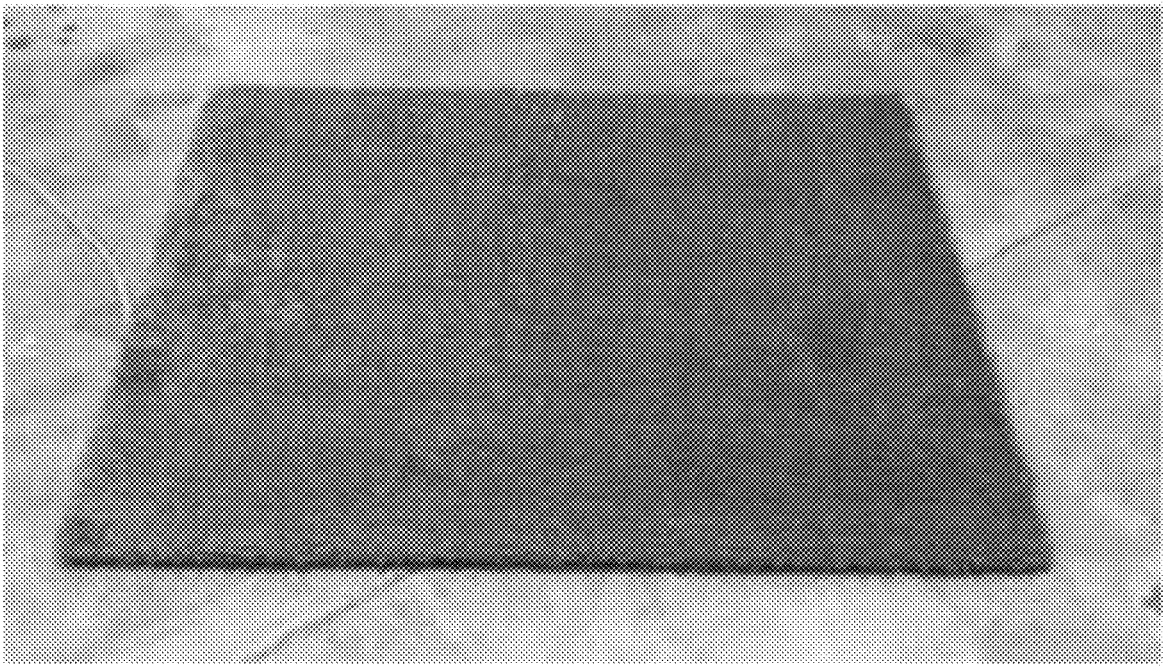

To fasten the turf section to the base structure, the turf section and base structure are preferably positioned upright, and the edges lifted or otherwise exposed to allow the fasteners to be inserted there around. If zip ties are used, it is preferred to insert the zip tie from the bottom, as illustrated in FIGS. 7G and 7H. Once the fasteners are in place, any turf fibers trapped under the fasteners can be pulled out from under the fasteners such that the fasteners will be below the level of the turf fibers and buried within the turf so as not to be noticeable in the finished modular turf section, as illustrated in FIG. 7I.

The finished modular turf sections can then be installed side by side to cover the desired surface area (as illustrated in FIGS. 3 and 4). The walls or other structure defining the perimeter of the area of installation serve to prevent the modular turf sections from sliding or from otherwise undesired movement relative to each other. Nonetheless, if the modular turf sections will be used in an unbounded area and will receive excessive forces which could cause movement thereof, the edges of adjacent modular turf sections can be fastened together by any suitable clamps, clips, ties, tapes or other suitable fasteners. Alternatively, the modular turf sections can be installed upon a non-slip surface such as a carpet-like rubber mat, or a non-slip coating or pad can be applied to or affixed to the bottom feet of the base structure. Further, suitable step rails, brackets or tapered edging can be attached to or located against the free edges of the modular turf sections and secured to the floor when necessary to provide a smooth transition from the ground surface to the to of the modular turf sections and to prevent movement thereof. Such step rails, brackets or tapered edging could also form a boundary for the modular turf system.

Figure 9:
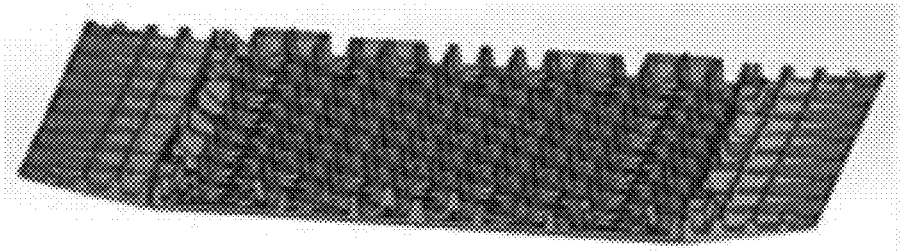
FIG. 9 is a bottom perspective view of a base structure of a modular turf section.
Figure 10:
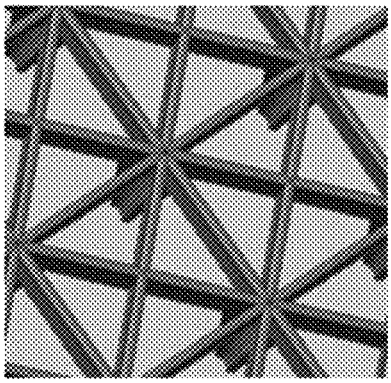
FIG. 10 is an enlarged top perspective view of a portion of the base structure of a modular turf section.
Figure 11:
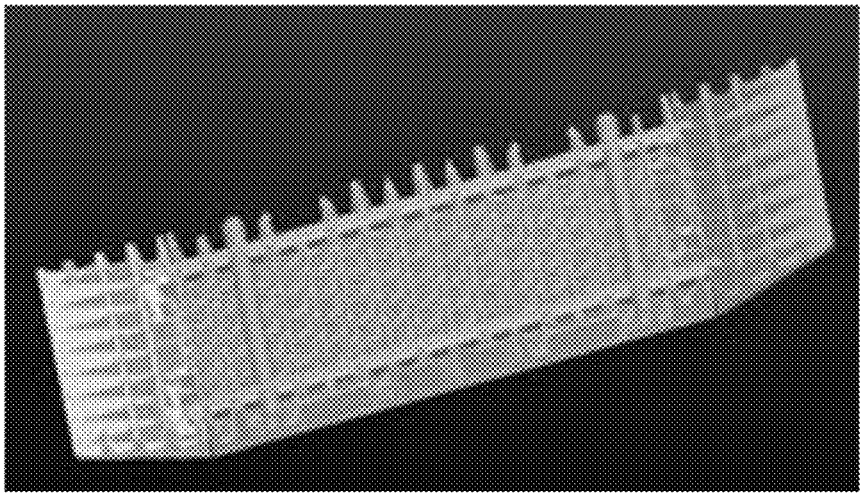
FIG. 11 a bottom perspective, view of a base structure incorporating a flushing system.

FIGS. 9-11 illustrate the base structure of the modular turf sections. FIG. 9 is a bottom perspective view of the base structure comprising one or more snap-together tiles, with tampered edge pieces snapped thereto along two sides thereof, as illustrated. FIG. 10 is a close up view of a portion of the snap-together tiles showing the drainage holes and the legs of the tiles. FIG. 11 is a bottom perspective view of the base structure comprising one or more snap-together tiles, with tampered edge pieces snapped thereto along two sides thereof, as illustrated, and incorporating a flushing system.

These tiles comprising the base structure are designed specifically for use as a drainage tile under synthetic turf. These tiles have a smooth surface so as not to abrade the bottom of the synthetic turf, unlike remit-posed "sport court" tiles which are rough at the top surface. The tiles are interlocking fix assembly/disassembly into squares and rectangles for the modular turf sections of any desired size and shape. Preferably, the tiles are designed to be exactly 1' by 1' prior to being snapped together to form the base structure.

As can be seen in FIG. 11, the tiles have channels formed underneath them through which are run or in which are placed a PVC flushing, system in either direction (both directions shown). The leg patterns in the tiles, as illustrated in FIG. 11, are designed to have an approximately ¾" channel, or other appropriately sized channel, running along the edge on all four sides of the tile so that when snapped together to form the base structure, and when a plurality of base structures are laid side by side in rows or columns, the modular turf system will be able to sit on top of half inch PVC pipes. These channels create an increased percentage of voids (space between support structures) that creates an increased percentage of piping area for additional liquid flow in the PVC flushing system.

The pipes preferably run the entire width or length of the area covered by the modular turf system and connect to a water source where cleaners can be added. The PVC pipes have appropriately spaced apart holes or openings therein so water will flush from the pipes and run underneath the modular turf system, thus acting as a flushing system to flush and clean thereunder. The plastic tiles are designed to sit on top of or over the half inch PVC pipes without creating at hump or bump in modular turf system. It should be understood that the pipes can be of any appropriate size as long as they suitably fit into the channels, and made of any suitable material such as metal, clay or other plastic material or the like.

Figure 12:
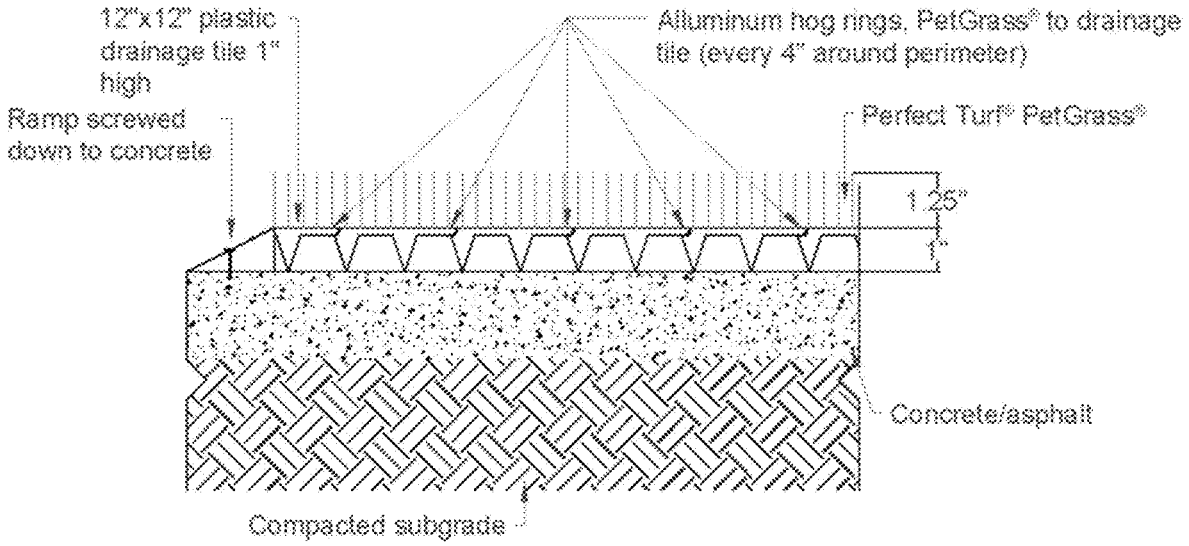
FIG. 12 is an alternate schematic cross-section view of a modular turf section placed on a surface.

FIG. 12 illustrates an alternate schematic cross-section view of a modular turf section placed on a surface. As illustrated, tapered edges or ramps are used as a border, and are secured to the floor surface such as a concrete slab. As can be seen, the modular turf section comprises a modular base structure, to which a corresponding sited and shaped section of synthetic turf is secured along the periphery thereof via suitable fasteners. As illustrated, the fasteners are aluminum hog rings. However, it should be understood that any suitable fasteners may be used, for example, staples, clips, clamps, wires or the like. In a preferred embodiment, metal hog rings are formed around top surface along the periphery of the turf and the base structure using a commercially available hog ring tool, and do not encircling the edge surface of the base structure. Preferably, the fasteners are located approximately every four inches around the perimeter of the modular turf section, however, this distance can vary depending on preference and the amount and nature of use or traffic on the turf.

Figure 8:
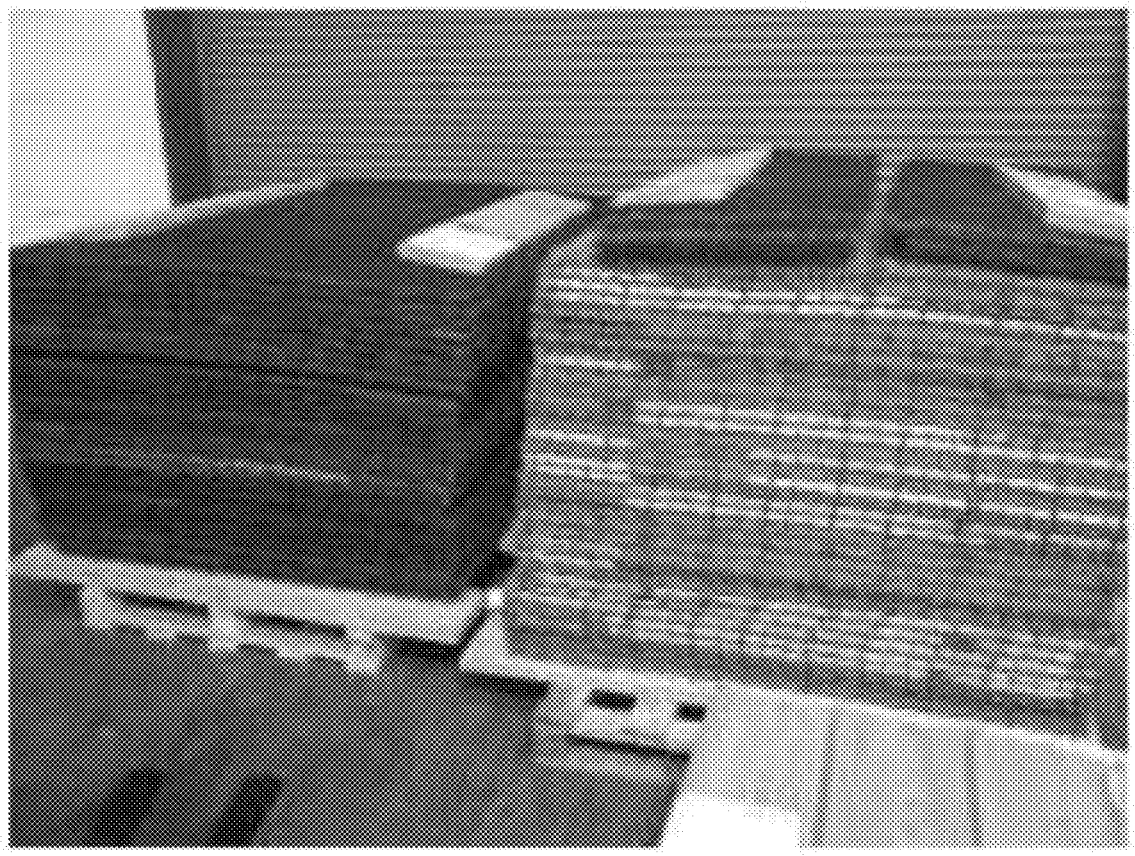
FIG. 8 is a perspective view of the modular turf sections stacked on pallets for storage and/or shipping.

The modular turf sections can easily be installed relatively quickly by non-professionals or do-it-yourselfers, resulting in substantial time and cost savings. Further, the modular turf sections are portable, allowing them to be moved from and to any installation site desired, thereby allowing for a temporary installation if desired. The modular turf sections also result in an easier and more convenient shipping method, as they can simply be stacked upon pallets for storage and/or shipping, as illustrated in FIG. 8.

While the foregoing discussion presents the teachings in an exemplary fashion with respect to the disclosed method and system for a modular turf system and method of turf installation, it will be apparent to those skilled in the art that the teachings may apply to any type of modular or portable turf system, customizable to any size and shape area. Further, while the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein.

What is claimed is:

1. A modular turf section, comprising:

a base structure comprising a plurality of interconnecting drainage tiles, wherein the base structure defines a customizable size and shape;

wherein each of the plurality of drainage tiles has four piping channels formed in an underside of each drainage tile, and wherein the four piping channels define a plurality of piping areas in the base structure arranged in a grid pattern running in both a first direction and a second direction perpendicular to the first direction;

a turf section of a size and shape, substantially corresponding to the size and shape of the base structure;

one or more fasteners for securing the turf section to the base structure; and piping associated with the plurality of piping areas of the base structure, wherein the piping runs in two directions through the base structure.

2. The modular turf section of claim 1, further comprising a flushing system associated with the piping.

3. The modular turf section of claim 1, wherein the turf section comprises synthetic turf having a permeable backing, and wherein the synthetic turf incorporates antimicrobial agents.

4. The modular turf section of claim 1, wherein the piping comprises half inch PVC pipes.

5. The modular turf section of claim 1, wherein the modular turf section is portable and liftable by hand.

6. A modular turf system, comprising:

a plurality of modular turf sections, each comprising a base structure comprising a plurality of interconnecting drainage tiles, wherein the base structure defines a customizable size and shape with a corresponding turf section attached thereto;

wherein each of the plurality of drainage tiles has four piping channels formed in an underside of each drainage tile, and wherein the four piping channels define a plurality of piping areas in the base structure arranged in a grid pattern running in both a first direction and a second direction perpendicular to the first direction;

piping associated with the plurality of piping areas of the base structures of the plurality of modular turf sections, wherein the piping runs in two directions;

a flushing system associated with the piping; and wherein the modular turf sections are placed side by side to cover a desired surface area, and wherein the piping runs in a grid pattern through each of the modular turf sections.

7. The system of claim 6, wherein each modular turf section further comprises one or more fasteners for securing the turf section to the base structure.

8. The system of claim 6, wherein angles or cutouts are formed in one or more modular turf sections to conform to the desired surface area.

9. The system of claim 6, wherein the piping includes a plurality of flush pipes.

10. The system of claim 6 wherein the turf section comprises synthetic turf having a permeable backing, and wherein the synthetic turf incorporates antimicrobial agents.

11. The system of claim 6, wherein the piping comprises half inch PVC pipes.

12. The system of claim 6, wherein the modular turf system is portable and liftable by hand.

13. A method of synthetic turf installation, comprising the steps of:

forming a plurality of modular turf sections by attaching a turf section to a corresponding base structure comprising a plurality of interconnecting drainage tiles, wherein the base structure defines a customizable size and shape to form each modular turf section;

forming four pining channels in an underside of each of the plurality of drainage tiles to define a plurality of piping areas arranged in a grid pattern running in both a first direction and a second direction perpendicular to the first direction in the base structure of each of the plurality of modular turf sections;

placing at least two of the modular turf sections adjacent each other to cover a desired surface area;

associating piping with the plurality of piping areas of the base structures of the plurality of modular turf sections, wherein the piping runs in two directions; and attaching a flushing system to the piping.

14. The method of claim 13, further comprising the step of attaching each turf section to its corresponding base structure via one or more fasteners.

15. The method of claim 13, further comprising the step of cutting angles or cutouts in one or more of the modular turf sections to conform to the desired surface area.

16. The method of claim 13, wherein the step of associating piping with the plurality of piping areas of the base structures of the plurality of modular turf sections comprises providing a plurality of flush pipes running in at least two directions within the plurality of piping areas and interconnecting in a grid pattern.

17. The method of claim 13 wherein each turf section comprises synthetic turf having a permeable backing, and wherein the synthetic turf incorporates antimicrobial agents.

18. The method of claim 13 further comprising the step of individually removing or displacing one or more of the modular turf sections by hand.

19. The method of claim 13, further comprising the step of providing a liquid to each of the plurality of drainage tiles via the piping.

* * * * *